US009902519B2

(12) United States Patent
Wright et al.

(10) Patent No.: US 9,902,519 B2
(45) Date of Patent: Feb. 27, 2018

(54) CUTTING TOOL AND METHOD OF OPERATING SAME

(71) Applicant: The Boeing Company, Huntington Beach, CA (US)

(72) Inventors: David Scott Wright, Snohomish, WA (US); Christine Mary Anderson, Edmonds, WA (US); Curt Backman, Seattle, WA (US); Donald Wayne Coffland, Seattle, WA (US); Aaron Robert Ayers, Granite Falls, WA (US); Donald Richard Young, Tulalip, WA (US)

(73) Assignee: THE BOEING COMPANY, Chicago, IL (US)

( * ) Notice: Subject to any disclaimer, the term of this patent is extended or adjusted under 35 U.S.C. 154(b) by 49 days.

(21) Appl. No.: 14/876,317

(22) Filed: Oct. 6, 2015

(65) Prior Publication Data

US 2016/0059985 A1 Mar. 3, 2016

Related U.S. Application Data

(62) Division of application No. 13/312,290, filed on Dec. 6, 2011, now Pat. No. 9,186,804.

(51) Int. Cl.

| | |
|---|---|
| ***B26D 1/14*** | (2006.01) |
| ***B26D 7/01*** | (2006.01) |
| ***B65B 69/00*** | (2006.01) |
| ***B26B 25/00*** | (2006.01) |
| ***B26B 27/00*** | (2006.01) |

(Continued)

(52) U.S. Cl.

CPC ..... *B65B 69/0025* (2013.01); *B26B 25/005* (2013.01); *B26B 27/00* (2013.01); *B26B 29/06* (2013.01); *B26D 1/14* (2013.01); *B26D 7/01* (2013.01); *B65B 25/00* (2013.01); *B65B 27/10* (2013.01); *Y10T 83/04* (2015.04)

(58) Field of Classification Search

CPC ..... B65B 69/0025; B65B 27/10; B65B 25/00; B26D 7/01; B26D 1/14; B26B 29/06; B26B 25/005; B26B 27/00

See application file for complete search history.

(56) References Cited

U.S. PATENT DOCUMENTS

| | | | |
|---|---|---|---|
| 1,024,924 | A | 4/1912 | Brunhoff |
| 1,194,528 | A | 8/1916 | MacDonald |

(Continued)

FOREIGN PATENT DOCUMENTS

| | | | |
|---|---|---|---|
| JP | S5419300 | A | 2/1979 |
| JP | 03171128 | U | 10/2011 |

OTHER PUBLICATIONS

Report of Second Office Action for related Chinese Patent Application No. 2012800584878 dated Aug. 6, 2015; 15 pp.

*Primary Examiner* — Jonathan Riley

(74) *Attorney, Agent, or Firm* — Armstrong Teasdale LLP

(57) ABSTRACT

A cutting tool and method of operating cutting tool. The tool includes a support having a first side and a second side. The tool further includes a handle coupled to at least one of the first side and the second side. The handle includes a blade, wherein the handle is configured to move the blade between a first position and a second position. An alignment guide is coupled to the support. The alignment guide includes a channel configured to receive the blade positioned in the second position.

16 Claims, 6 Drawing Sheets

(51) Int. Cl.

| | |
|---|---|
| ***B65B 25/00*** | (2006.01) |
| ***B65B 27/10*** | (2006.01) |
| ***B26B 29/06*** | (2006.01) |

(56) References Cited

U.S. PATENT DOCUMENTS

| | | | | | |
|---|---|---|---|---|---|
| 1,860,454 | A | | 5/1932 | Dessell | |
| 1,914,528 | A | | 6/1933 | Reid | |
| 2,599,439 | A | | 6/1952 | Drake | |
| 3,045,348 | A | | 7/1962 | Dungan | |
| 3,085,330 | A | | 4/1963 | Lewinski et al. | |
| 3,153,853 | A | | 10/1964 | Lipton | |
| 3,168,119 | A | | 2/1965 | Schwester et al. | |
| 3,484,940 | A | * | 12/1969 | Zell, Jr. | B26B 3/00 30/162 |
| 3,624,901 | A | | 12/1971 | Pettit et al. | |
| 3,911,575 | A | | 10/1975 | Anesi | |
| 4,022,182 | A | | 5/1977 | Lenkevich | |
| 4,360,970 | A | | 11/1982 | Ostroski et al. | |
| 4,382,330 | A | | 5/1983 | Harbaugh | |
| 4,442,559 | A | | 4/1984 | Collins | |
| 4,459,717 | A | * | 7/1984 | Halstead | B25B 25/00 30/250 |
| 4,707,920 | A | | 11/1987 | Montgomery | |
| 4,805,818 | A | | 2/1989 | Harrison | |
| 5,206,965 | A | | 5/1993 | Rowley | |
| 5,285,576 | A | | 2/1994 | Taylor | |
| 5,309,802 | A | * | 5/1994 | Mammosser | B26B 27/00 30/278 |
| 5,617,635 | A | | 4/1997 | Berns | |
| 5,887,346 | A | * | 3/1999 | McCasland | B26F 1/0023 30/90.1 |
| 6,101,721 | A | | 8/2000 | Medhurst | |
| 6,276,059 | B1 | * | 8/2001 | Kan | B26B 27/005 30/2 |
| 6,367,154 | B2 | | 4/2002 | Degabli | |
| 6,752,053 | B2 | | 6/2004 | Rubicam | |
| 6,938,343 | B2 | | 9/2005 | Yamagishi | |
| 7,213,284 | B2 | | 5/2007 | Huang et al. | |
| 7,290,339 | B1 | | 11/2007 | Schmelzer | |
| 7,624,507 | B2 | | 12/2009 | Bergstrand | |
| 7,958,639 | B2 | | 6/2011 | Ireland et al. | |
| 8,104,180 | B2 | | 1/2012 | Swinford | |
| 2005/0086812 | A1 | | 4/2005 | Votolato | |
| 2007/0204470 | A1 | * | 9/2007 | Lai | B26B 17/00 30/244 |
| 2007/0245571 | A1 | | 10/2007 | Pearson | |
| 2008/0155838 | A1 | | 7/2008 | Bergstrand | |
| 2009/0071014 | A1 | | 3/2009 | Chow | |
| 2009/0188118 | A1 | * | 7/2009 | Swinford | B25B 7/02 30/252 |
| 2009/0271988 | A1 | | 11/2009 | Votolato | |
| 2009/0300920 | A1 | | 12/2009 | Jiang et al. | |
| 2010/0206148 | A1 | * | 8/2010 | Reyes | B26B 27/00 83/53 |
| 2011/0265332 | A1 | | 11/2011 | Cornell et al. | |
| 2012/0110863 | A1 | | 5/2012 | Brown et al. | |

* cited by examiner

CUTTING TOOL AND METHOD OF OPERATING SAME

CROSS REFERENCE TO RELATED APPLICATIONS

This application is a divisional of, and claims priority to, U.S. patent application Ser. No. 13/312,290 filed Dec. 6, 2011, entitled "CUTTING TOOL AND METHOD OF OPERATING SAME," which is hereby incorporated by reference in its entirety.

BACKGROUND OF THE INVENTION

The present disclosure relates generally to a cutting tool, and more specifically, to methods and systems for cutting fasteners.

Fasteners such as tie wraps, also known as "zip ties," are commonly used for a variety of purposes in industrial settings. For example, such tie wraps are commonly used to secure electrical wires in bundles. It is common, particularly in routing electrical wires, to use tie wraps to bind bundles of wires together. The binding of wire bundles allows similar groupings of wires to be grouped together to facilitate installation of the wires. Further, tie wraps prevent wires from tangling and enables better wire management.

Known tie wraps include a strap having a securing mechanism integral therewith. A distal end of the tie wrap is passed through an opening in the securing mechanism. The securing mechanism contains a tab that engages teeth spaced along the length of the strap. The tab engages successive teeth as the strap is pulled through the securing mechanism. Moreover, the tab acts as a ratchet to effectively prevent the strap from being removed after it is installed.

Tie wraps are sometimes removed after installation of the wire bundles and/or during later maintenance operations. Typically, personnel use conventional wire cutters, razor knives, or similar cutting tools to remove the tie wraps. During removal of the tie wraps, insulation covering one of the wires may be moderately nicked or cut with the cutting tool. Damaged insulation may require repair or require the wire and/or the bundle of wires to be replaced, this damage leads to costly and/or time-consuming outages or delays. Further, in some instances, conventional cutting tools have exposed blades that may result in minor injuries that require attention and further delays.

BRIEF DESCRIPTION OF THE INVENTION

In one aspect, a cutting tool is provided. The tool includes a support having a first side and a second side. The tool further includes a handle coupled to at least one of the first side and the second side. The handle includes a blade, wherein the handle is configured to move the blade between a first position and a second position. An alignment guide is coupled to the support, wherein the alignment guide includes a channel configured to receive the blade positioned in the second position.

In another aspect, a tool for use in cutting a tie wrap bound about at least one wire is provided. The tool includes a support having a first side and a second side. The support further includes a slot defined through the first side and the second side. The tool includes a handle rotatably coupled to the first side. The handle includes a blade axle and a blade coupled thereto, wherein the blade axle extends into the slot. The handle is configured to rotatably move the blade from a first position to a second position. An alignment guide includes a channel configured to receive the blade positioned in the second position and to align the blade to at least partially cut the tie wrap.

In a further aspect, a method of operating a cutting tool to cut a tie wrap bound about at least one wire is provided. The method includes applying a guide member of the tool to a tie wrap. The method also includes positioning a portion of the tie wrap within a channel of the guide member. The method includes moving the at least one wire and maintaining the at least wire away from tie wrap. The blade is moved into the channel to at least partially cut the tie wrap with the blade as the blade moves into the channel.

The features, functions, and advantages that have been discussed can be achieved independently in various embodiments or may be combined in yet other embodiments further details of which can be seen with reference to the following description and drawings.

Although specific features of various embodiments may be shown in some drawings and not in others, this is for convenience only. Any feature of any drawing may be referenced and/or claimed in combination with any feature of any other drawing.

DETAILED DESCRIPTION OF THE INVENTION

The embodiments described herein relate to a resilient cutting process. Generally, the embodiments relate to a cutting tool for cutting a fastener that contains an object, such as a bundle of wires. The cutting tool is utilized to cut a plurality of fasteners such as, but not limited to, strings, adhesives, wires and tie wraps. Moreover, the cutting tool is utilized to cut fasteners used in a variety of environments such as, but not limited to, industrial, military and consumer environments. In one application, the cutting tool described herein is utilized to cut a tie wrap disposed about a bundle of wires. It should be understood that the embodiments described herein are not limited to tie wraps, and further understood that the description and figures that utilize tie wraps and wires are exemplary only. The present invention is compatible with known tie wraps while providing a cutting process that is safe, ergonomic and non-damaging to wires contained by the fastener being cut.

Figure 1:
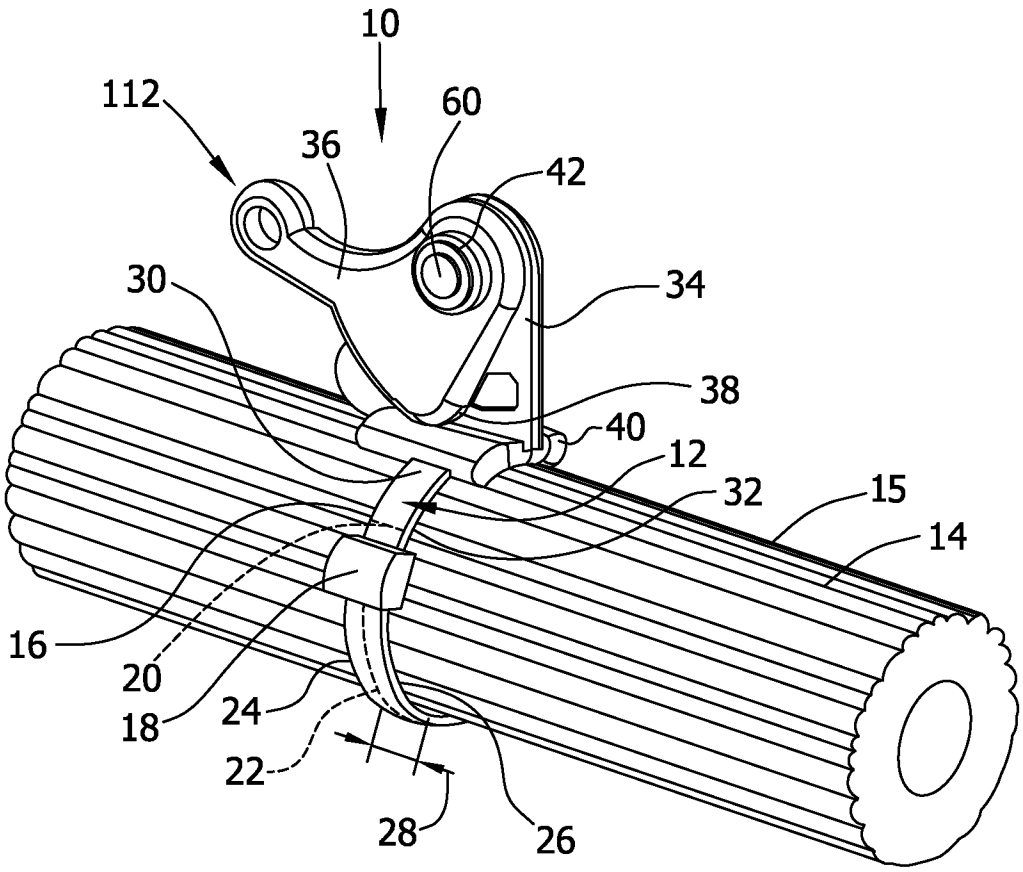
FIG. 1 illustrates a perspective view of an exemplary cutting tool that may be used to cut a fastener.

FIG. 1 illustrates a cutting tool 10 coupled to a fastener such as, but not limited to, a tie wrap 12, extending about at least one wire 14. In the exemplary embodiment, tie wrap 12 includes a strap 16 having a securing mechanism 18 formed integrally therewith and extending across a lateral axis 20 and a longitudinal axis 22 of strap 16 between side 24 and opposing side 26 of strap 16. Strap 16 has a thickness 28 defined between a top surface 30 and a bottom surface 32. A distal end (not shown) of tie wrap 12 is passed through securing mechanism 18. Mechanism 18 includes a tab (not shown) that engages teeth (not shown) spread along length of strap 16. Tab engages successive teeth as strap 16 is pulled, under tension, through securing mechanism 18 to bundle wires 14 together.

In the exemplary embodiment, tool 10 at least partially cuts tie wrap 12 to facilitate removing tie wrap 12 from wire 14. More specifically, to facilitate maximizing its effectiveness, tool 10 cuts tie wrap 12 without damaging wire 14 and without injury to the user (not shown). Tool includes a support 34, a handle 36, a blade 38, an alignment guide 40 and a bias 42.

Figure 2:
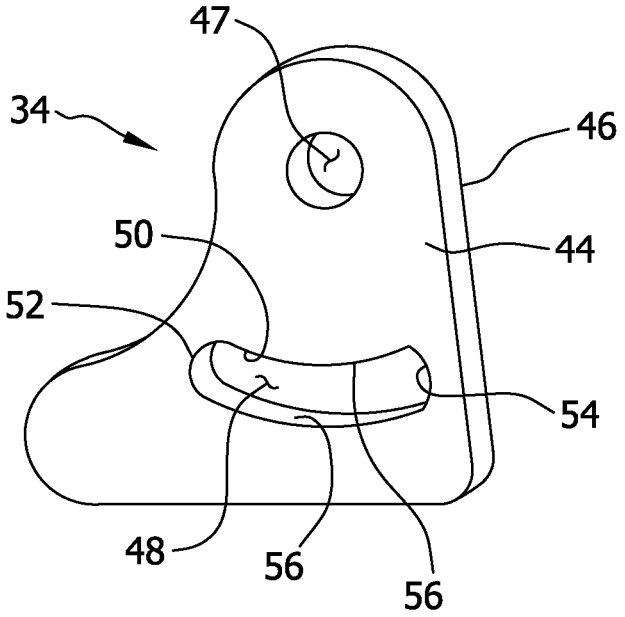
FIG. 2 illustrates side view of a support of the cutting tool shown in FIG. 1.

FIG. 2 illustrates a side view of tool support 34. Support 34 is coupled to handle 36 (shown in FIG. 1) to enable cutting processes. Support 34 includes a first side 44, a second side 46, and a pivot opening 47 defined through first side 44 and second side 46. A slot 48 is defined in support 34 by an arcuate surface 50. More particularly, slot 48 is defined by a first end 52, a second end 54, and opposing sides 56 that extend between first end 52 and second end 54. To facilitate cutting tie wrap strap 16, slot 48 is sized, shaped and orientated to enable guiding blade 38 as handle 36 moves blade 38 during cutting processes as described herein. In the exemplary embodiment, slot 48 facilitates depth control of blade 38 during cutting processes.

Figure 3:
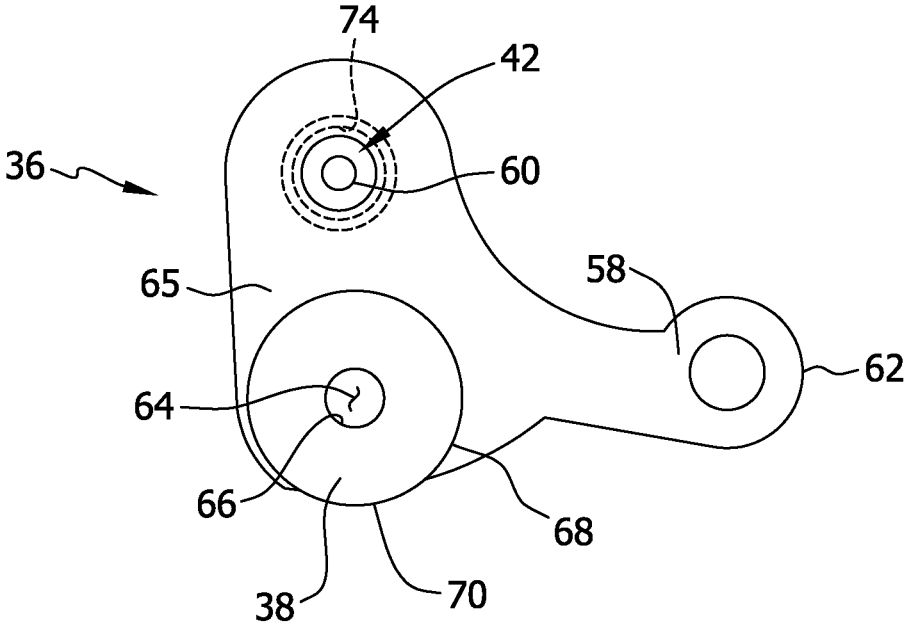
FIG. 3 illustrates a side view of a handle of the cutting tool shown in FIG. 1.

FIG. 3 illustrates a side view of tool handle 36. As illustrated, blade 38 and bias 42 are coupled to handle 36. Handle 36 includes an actuator arm 58 and a pivot pin 60. Actuator arm 58 enables handling of tool 10 by the user. In the exemplary embodiment, actuator arm 58 includes an end 62 that facilitates ergonomic handling of tool 10. In the exemplary embodiment, end 62 has a generally cylindrical shape which facilitates tool 10 being used by the user's fingers. Alternatively, end 62 may have any shape that enables handle 36 to function as described herein. Pivot pin 60 is coupled to actuator arm 58 and extends through support pivot opening 47 (shown in FIG. 2) to couple handle 36 to support 34. In the exemplary embodiment, pivot pin 60 rotatably couples handle 36 to support 34 about support pivot opening 47.

Handle 36 also includes a blade axle 64 that is coupled to a side 65 of handle 36 and extends outward therefrom. Blade axle 64 is configured to extend into slot 48 (shown in FIG. 2) to facilitate moving blade 38 as described herein. In the exemplary embodiment, blade axle 64 is circular-shaped to facilitate coupling to blade 38. Alternatively, blade axle 64 may have any shape that enables blade 38 to function as described herein.

Blade 38 is coupled to blade axle 64 to enable at least a portion 114 (shown in FIG. 8) of tie wrap 12 to be at least partially cut as described herein. Blade 38 includes an inner mounting surface 66 and an outer cutting surface 68. Inner mounting surface 66 is coupled to blade axle 64. In one embodiment, inner mounting surface 66 is rotatably coupled to blade axle 64. Blade 38 is rotatably coupled to blade axle 64 to facilitate increasing usable cutting surface 68 to improve blade life by allowing the entire cutting surface 68 to be rotatably used during cutting processes. As illustrated in FIG. 3, a portion 70 of outer cutting surface 68 extends beyond handle 36. In the exemplary embodiment, blade 38 is a circular blade having a diameter with a size range from about 10 mm (0.40 in.) to about 40 mm (1.6 in.). More particularly, in the exemplary embodiment, blade 38 has a diameter with a size range between about 18 mm (0.71 in.) to about 28 mm (1.1 in.). Blade 38 is variably selected to have a size that accommodates for at least partially cutting a plurality of different sized tie wrap straps 14. Any size blade 38 may be used that enables tool 10 to function as described herein.

Bias 42 is coupled to handle 36 to enable moving handle 36 under tension force. More particularly, bias 42 is coupled to handle 36 and adjacent pivot pin 60. Bias 42 includes a tension member 74 such as, but not limited to, a spring coupled to handle 36. In the exemplary embodiment, tension member 74 includes a torsion spring. Any type of spring may be used that enables tool 10 to function as described herein.

Figure 4:
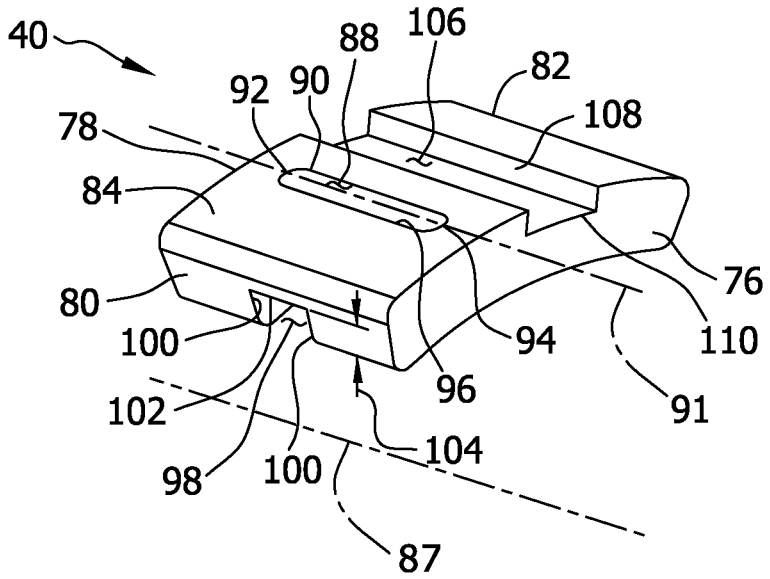
FIG. 4 illustrates a perspective view of an alignment guide of the cutting tool shown in FIG. 1.
Figure 5:
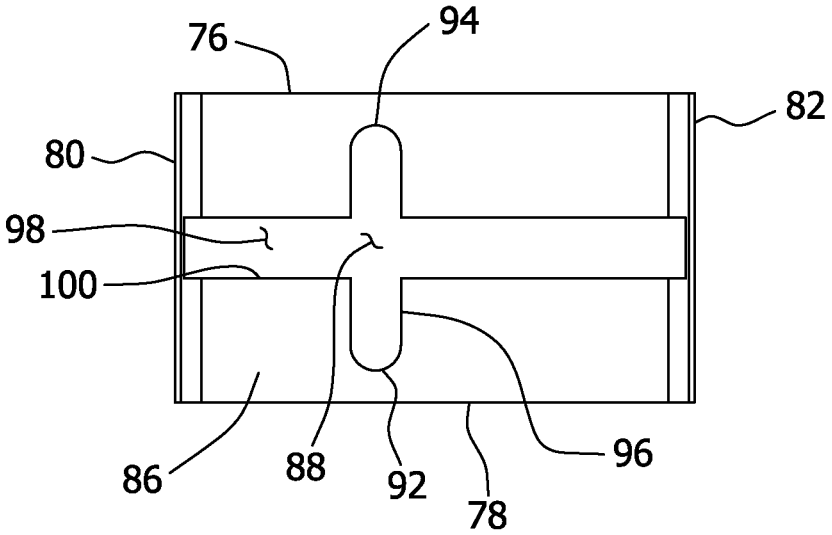
FIG. 5 illustrates a bottom view of the alignment guide shown in FIG. 1.

FIG. 4 illustrates a perspective view of alignment guide 40. FIG. 5 illustrates a bottom view of alignment guide 40. Alignment guide 40 is coupled to support 34 to enable aligning blade 38 (shown in FIG. 1) with tie wrap 12 (shown in FIG. 1) during cutting processes. In the exemplary embodiment, alignment guide 40 includes a first end 76 and an opposing second end 78 and includes a first side 80 and an opposing second side 82 extending between first end 76 and second end 78. Moreover, alignment guide 40 includes a first surface 84 and a second surface 86 extending between first side 80 and a second side 82. Second surface 86 is configured to extend beyond support 34 and handle 36. In an embodiment, second surface 86 is wedge-shaped. In alternative embodiments, second surface 86 can have any other shapes such as, but not limited to, round shapes and triangular shapes. Further, second surface 86 can include a plurality of sizes and shapes to facilitate variable selection to accommodate strap thickness 28 (shown in FIG. 1). In the illustrated embodiment, second surface 86 is curved about a central axis 87 to facilitate coupling at least a portion of second surface 86 to a curved outer surface 15 of the at least one wire 14 (shown in FIG. 1). The configuration of second surface 86 is to accommodate for contacting and moving wire 14 (shown in FIG. 1) when alignment guide 40 is coupled to strap 16. Any size and shape of second surface 86 may be used that enables tool 10 to function as described.

A channel 88 is defined by an arcuate surface 90 along a longitudinal axis 91 of alignment guide 40. Channel 88 extends between first surface 84 and second surface 86 and between first end 76 and second end 78. More particularly, channel 88 is defined by an end 92, an end 94, and opposing sides 96 extending between end 92 and end 94. To facilitate at least partially cutting tie strap 16, channel 88 is sized, shaped and orientated to receive blade 38 (shown in FIG. 1) and to enable guiding blade 38 relative to channel 88 as handle 36 moves blade 38 during cutting processes as described herein. In the exemplary embodiment, channel 88 receives and guides blade portion 70 (shown in FIG. 3) that extends beyond handle 36 (shown in FIG. 3).

As illustrated, alignment guide 40 includes a groove 98 formed within first side 80 and second side 82. To facilitate positioning of tool 10 relative to tie strap 16, groove 98 aligns handle 36 (shown in FIG. 1) about strap 16 (shown in FIG. 1) to facilitate controlling a pre-determined depth of blade 38 during cutting processes. Groove 98 is defined by opposing sidewalls 100 and an end 102 that extends between sidewalls 100. In the exemplary embodiment, groove 98 is located substantially perpendicular to channel 88. Moreover, groove 98 is in flow communication with channel 88.

In the exemplary embodiment, groove side wall 100 has a length 104 that is variably selected to accommodate for strap thickness 28 (shown in FIG. 1) when alignment guide 40 is applied to strap 16. Groove 98 can be sized and shaped to accommodate alignment guide 40 about different sized straps 16. Any shape and size of groove 98 may be used that enables tool 10 to function as described herein.

Alignment guide 40 also includes another groove 106 formed in first surface 84 and extending between first end 76 and second end 78. Groove 106 is defined by opposing sidewalls 108 and end wall 110 extending between sidewalls 108. Sidewalls 108 are sized and shaped to receive support 34 (shown in FIG. 2) and to couple to support 34.

Figure 6:
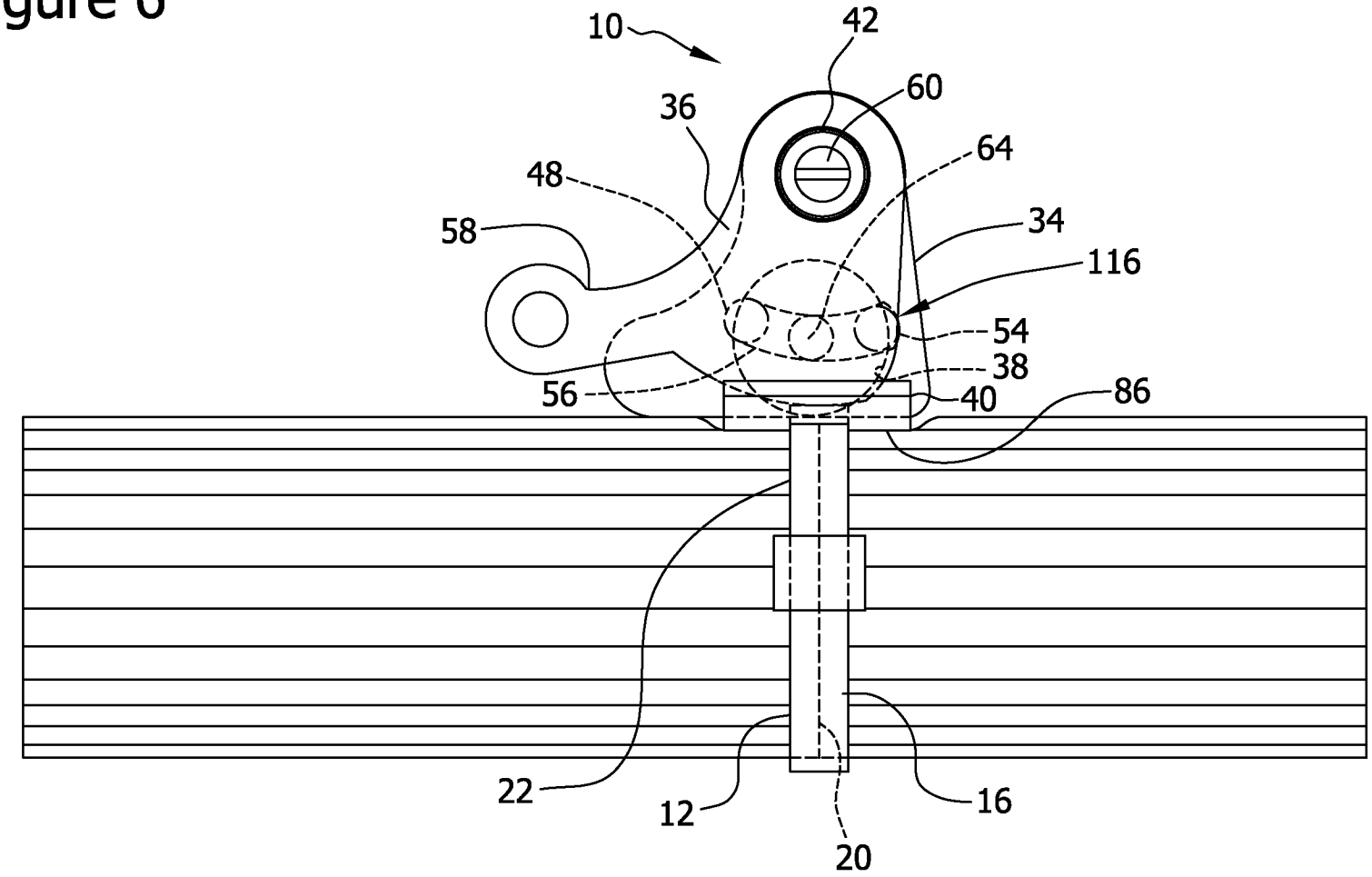
FIG. 6 illustrates a side view of the cutting tool coupled to the fastener shown in FIG. 1.
Figure 7:
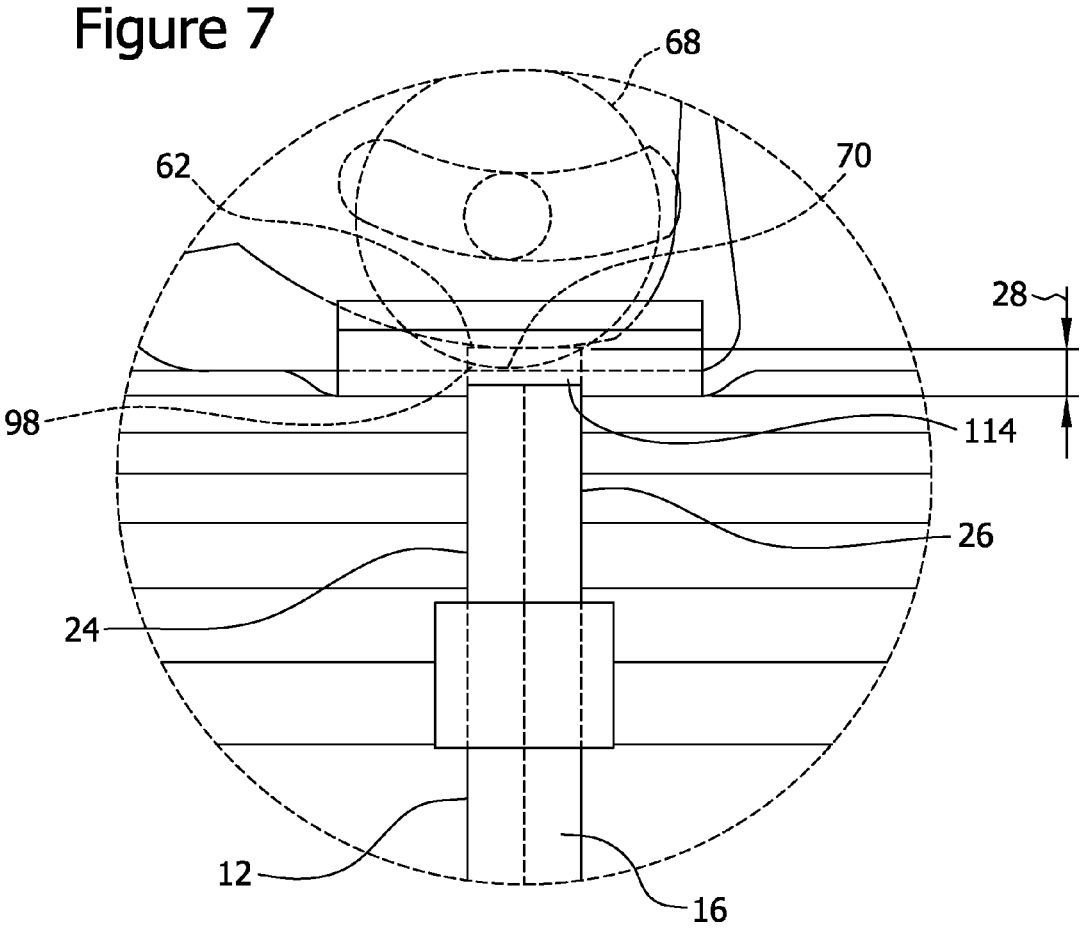
FIG. 7 illustrates a partial view of FIG. 6 illustrating the cutting tool and the fastener.
Figure 8:
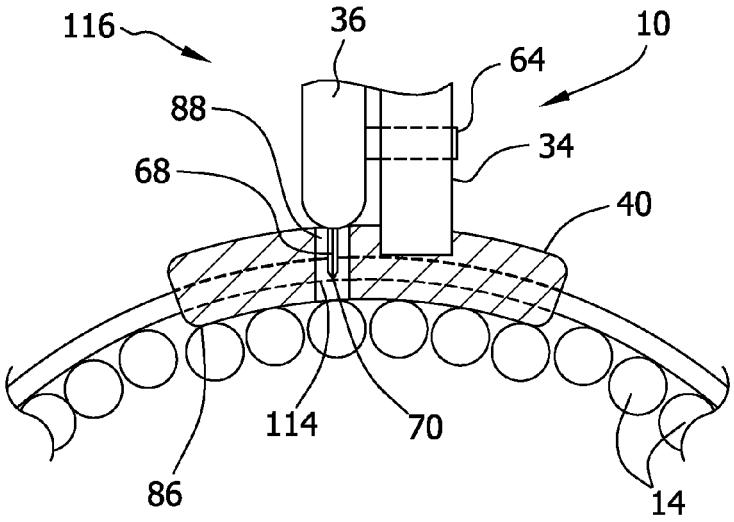
FIG. 8 illustrates a front view of FIG. 6 illustrating the cutting tool and the fastener.
Figure 9:
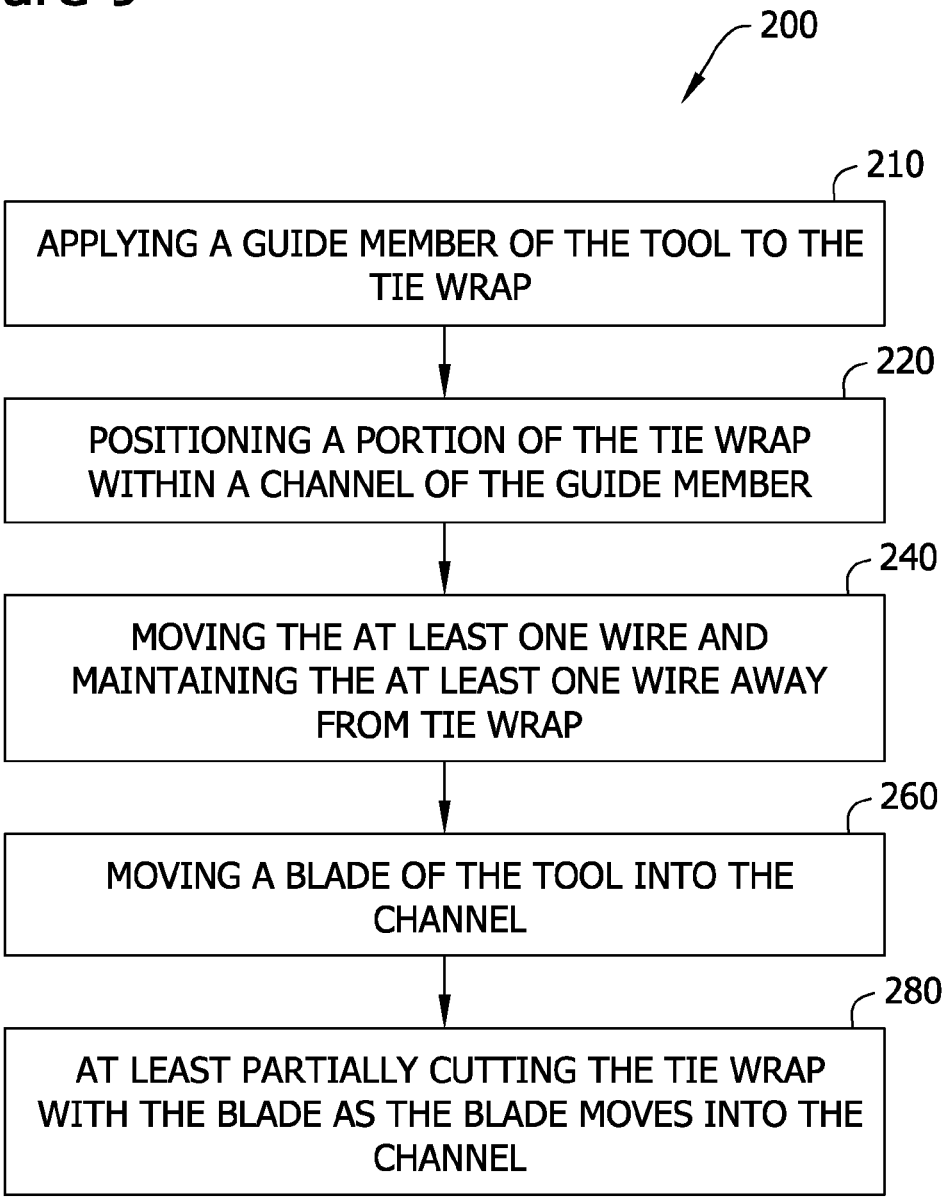
FIG. 9 illustrates a flowchart that illustrates an exemplary method of operation of an exemplary cutting tool.

FIG. 6 illustrates a side view of tool 10 coupled to tie wrap 12. FIG. 7 illustrates a partial view of FIG. 6. FIG. 8 illustrates a partial, front view of tool 10 coupled to tie wrap 12. FIG. 9 illustrates a flowchart 200 that illustrates an exemplary method of operation of cutting tool 10. Prior to a user (not shown) operating tool 10, bias 42 applies a tension force to handle 36 to position blade axle 64 and blade 38 in a first position 112 (shown in FIG. 1). In first position 112, blade axle 64 is adjacent first end of slot 48. Further, in first position 112, blade cutting surface 68 is maintained out of alignment channel 88 under force of bias 42.

In the exemplary embodiment, alignment guide 40 is applied to strap 16 via groove end wall 102 along longitudinal axis 22 of strap 16 such that strap 16 is inserted into groove 98. Groove 98 is open to alignment guide second surface 86, as shown for example in FIGS. 4 and 5, to facilitate insertion of strap 16 into groove 98 when alignment guide 40 is applied to strap 16. Length 104 of groove sidewall 100 facilitates controlling the depth of strap thickness 28 within groove 98. Because groove 98 is orientated substantially perpendicular to channel 88, channel 88 is positioned along lateral axis 20 of strap 16. Additionally, because groove 98 is in flow communication with channel 88, a portion of strap 114 is positioned 220 within channel 88. Channel 88 facilitates exposing strap 16 to blade 38 during cutting process.

In the exemplary embodiment, alignment guide 40 is applied to strap 16 via groove end wall 102 along longitudinal axis 22 of strap 16 such that strap 16 is inserted into groove 98. Length 104 of groove sidewall 100 facilitates controlling the depth of strap thickness 28 within groove 98. Because groove 98 is orientated substantially perpendicular to channel 88, channel 88 is positioned along lateral axis 20 of strap 16. Additionally, because groove 98 is in flow communication with channel 88, a portion of strap 114 is positioned 220 within channel 88. Channel 88 facilitates exposing strap 16 to blade 38 during cutting process.

As groove 98 is placed about strap 16, guide second surface 86 couples to wire 14 to facilitate moving and maintaining 240 wire 14 a distance away from strap 16. With alignment guide 40 applied to strap 16, the user moves actuator arm 58 to rotate arm about pivot pin 60. In the exemplary embodiment, the user rotates actuator arm 58 about support 34 in a counter-clockwise direction toward alignment guide 40. In response, blade axle 64 is moved within slot 48 to a second position 116 that is adjacent to slot second end 52. Because of arcuate surface 50, slot sidewalls 56 facilitates guiding blade axle 64 within slot 48 toward alignment guide 40. The user continues to rotate actuator arm 58 to move blade axle 64 to second position 116. As blade axle 64 is moved from first position 112 toward alignment guide 40 and to second position 116, blade 38 travels in the same arc direction as blade axle 64.

As previously noted, cutting surface 68 is maintained out of channel 88 in first position 112. As blade 38 moves with blade axle 64 to second position 116, blade 38 is moved into channel 88. In the exemplary embodiment, as blade axle 64 is moved to second position 116, blade cutting surface 68 is moved 260 into channel 88. Because blade 38 is received by channel 88, blade 38 is exposed to strap portion 114 that is located in channel 88. The user continues to move actuator arm 58 to move blade axle 64 to second position 116 and to apply cutting surface 68 against top surface 30 of strap 16 to at least partially cut 280 tie wrap 12 as cutting surface 68 moves into channel 88.

As cutting surface 68 cuts strap 16, groove 98 and slot 48 enable controlling depth of cutting surface 68 into strap 16. More particularly, because groove end 102 is coupled to top surface 30 of strap 16, cutting surface 68 is prevented from penetrating into strap 16 beyond exposed cutting surface 70. Moreover, because blade axle 64 follows arcuate shape of slot 48, slot 48 facilitates limiting blade movement within channel 88 to prevent cutting surface 68 from penetrating beyond strap 16 and into wire 14. Thus, the sizes, shapes and orientations of groove 98 and slot 48 facilitate to provide depth control for cutting surface 68 with respect to strap 16. The depth control by at least groove 98 and slot 48 prevents cutting surface 68 from cutting through strap 16 and contacting wire 14.

Since strap 16 is applied around wire 14 under tension, at least partially cutting strap 16 by cutting surface 68 facilitates breaking strap 16 to free wires 14. More particularly, tension force of strap 16 breaks strap 16 when cutting surface 68 at least partially cuts strap 16. Furthermore, guide second surface 86 enables moving and maintaining wire 14 away from strap 16 to minimize or prevent cutting surface 68 from contacting wire 14. Additionally, because cutting surface 68 is received by channel 88, cutting surface 68 is positioned to minimize or prevent user contact with cutting surface 68 to facilitate preventing injury to the user during cutting processes.

After strap 16 breaks and free wire 14, the user can release actuator arm 58. Upon release of actuator arm 58, bias 42 applies a return force to handle 36. In the exemplary embodiment, blade axle 64 is rotated from second position 116 to first position 112. Blade 38 also reverses direction and rotates with blade axle 64 and out of channel 88.

The subject matter described herein relates generally to cutting tools and, more particularly, to cutting tools for use in cutting tie wraps to free objects (e.g., wires) bound by a fastener (e.g., tie wraps). The tool includes a support and guide member that are positionable to facilitate aligning a blade and controlling the depth of the blade into the tie wrap during cutting procedures. The tool further prevents blade contact with the wire. As such, use of the tool described herein facilitates increasing the reliability and/or efficiency of cutting a tie wrap without damaging a wire and without injuring the user.

Exemplary embodiments of systems and methods for using a cutting tool are described above in detail. The systems and methods are not limited to the specific embodiments described herein, but rather, components of systems and/or steps of the method may be utilized independently and separately from other components and/or steps described herein. The disclosed dimensional ranges include all sub ranges there between. Further, tool may be fabricated from any material that enables tool to function as described herein. Each component and each method step may also be used in combination with other components and/or method steps. Although specific features of various embodiments may be shown in some drawings and not in others, this is for convenience only. Any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of operating a cutting tool to cut a tie wrap bound about at least one wire, the method comprising:

applying an outer surface of a guide member of the cutting tool to the at least one wire such that the tie wrap is positioned in a groove defined in and open to the outer surface and such that the outer surface contacts the at least one wire and maintains the at least one wire away from the tie wrap, wherein the outer surface of the guide member is concavely curved about a central axis to facilitate coupling at least a portion of the outer surface to a curved workpiece surface;

positioning a portion of the tie wrap within a channel of the guide member, the channel in flow communication with, and oriented substantially perpendicular to, the groove;

moving a blade of the cutting tool into the channel; and at least partially cutting the tie wrap with the blade as the blade moves into the channel.

2. The method according to claim 1 wherein applying the outer surface of the guide member to the at least one wire comprises positioning the groove of the guide member parallel to a longitudinal axis of the tie wrap.

3. The method according to claim 1, wherein the groove is defined by a pair of opposing sidewalls each having a length substantially perpendicular to the outer surface, and wherein applying the outer surface of the guide member to the at least one wire further comprises positioning the tie wrap at a pre-determined depth with respect to the blade within the channel, the pre-determined depth corresponding to the length of the opposing sidewalls.

4. The method according to claim 1 wherein the outer surface is a second outer surface of the guide member, the guide member further comprising a first outer surface opposing the second outer surface.

5. The method according to claim 1 wherein:

the channel includes a pair of opposing channel sides extending between a first end and a second end along a longitudinal axis of the channel, the outer surface is a second outer surface of the guide member, the guide member further comprising a first outer surface opposing the second outer surface, and the groove is defined by a pair of opposing sidewalls that each extend in a direction substantially perpendicular to the longitudinal axis and an end wall extending between the opposing sidewalls, and positioning the portion of the tie wrap within the channel comprises contacting the end wall of the groove against the tie wrap.

6. The method according to claim 5 wherein moving the blade of the cutting tool into the channel comprises moving the blade into the groove.

7. The method according to claim 6 wherein contacting the groove against the tie wrap comprises positioning the opposing sidewalls of the groove parallel to a longitudinal axis of the tie wrap.

8. The method according to claim 7 wherein at least partially cutting the tie wrap with the blade as the blade moves into the channel comprises at least partially cutting the tie wrap along a lateral axis of the tie wrap.

9. The method according to claim 1 wherein the blade is coupled to a handle of the cutting tool, and wherein moving the blade of the tool into the channel comprises moving the handle relative to the guide member.

10. The method according to claim 9 wherein a support is coupled between the handle and the guide member, and wherein moving the handle relative to the guide member further comprises moving the handle relative to the support.

11. The method according claim 10 wherein moving the handle relative to the support comprises rotating the handle relative to the support.

12. The method according to claim 10 wherein:

the outer surface is a second outer surface of the guide member, the guide member further comprising a first outer surface opposing the second outer surface, and the support is coupled to the first outer surface.

13. The method according to claim 12 wherein:

the channel includes a pair of opposing channel sides extending between a first end and a second end along a longitudinal axis of the channel, the groove is defined by a pair of opposing sidewalls that each extend in a direction substantially perpendicular to the longitudinal axis and an end wall extending between the opposing sidewalls, and positioning the portion of the tie wrap within the channel comprises contacting the end wall of the groove against the tie wrap.

14. The method according to claim 13 wherein moving the blade of the tool into the channel comprises moving the blade into the groove.

15. The method according to claim 14 wherein contacting the end wall of the groove against the tie wrap comprises positioning the opposing sidewalls of the groove parallel to a longitudinal axis of the tie wrap.

16. The method according to claim 15 wherein at least partially cutting the tie wrap with the blade as the blade moves into the channel comprises at least partially cutting the tie wrap along a lateral axis of the tie wrap.

* * * * *